US007331904B2

(12) United States Patent
Hall

(10) Patent No.: US 7,331,904 B2
(45) Date of Patent: Feb. 19, 2008

(54) TRAMPOLINE HAVING SUBSTANTIALLY SIMILAR MAT DEFLECTION UNDER VARYING LOADS

(76) Inventor: David Wayne Hall, 0525 S. 1160 E., Manti, UT (US) 84642

( * ) Notice: Subject to any disclaimer, the term of this patent is extended or adjusted under 35 U.S.C. 154(b) by 509 days.

(21) Appl. No.: 11/119,137

(22) Filed: Apr. 28, 2005

(65) Prior Publication Data

US 2006/0247101 A1 Nov. 2, 2006

(51) Int. Cl.
*A63B 21/00* (2006.01)

(52) U.S. Cl. ..... 482/27; 482/28

(58) Field of Classification Search ..... 482/26–28; 5/111, 187.74, 199, 200.1; 182/139
See application file for complete search history.

(56) References Cited

U.S. PATENT DOCUMENTS

| | | | |
|---|---|---|---|
| 4,162,063 | A | 7/1979 | Nissen et al. |
| 4,452,444 | A | 6/1984 | Schulze, Jr. |
| 4,824,100 | A | 4/1989 | Hall et al. |
| 5,637,057 | A | 6/1997 | Collura |
| 5,851,167 | A | 12/1998 | Li |
| 5,921,899 | A | 7/1999 | Rose |
| 6,220,585 | B1 | 4/2001 | Heron |
| 6,383,122 | B1 | 5/2002 | Graham |
| 6,390,956 | B1 | 5/2002 | Seelye et al. |
| 2003/0036460 | A1 | 2/2003 | Publicover |
| 2003/0104905 | A1 | 6/2003 | Publicover |
| 2004/0005962 | A1 | 1/2004 | Borsheim |
| 2004/0092366 | A1 | 5/2004 | Kyoung-chan et al. |

*Primary Examiner*—Jerome Donnelly
(74) *Attorney, Agent, or Firm*—Advantia Law Group; Michael W. Starkweathe; Jason P. Webb

(57) ABSTRACT

A novel trampoline at least includes: a trampoline frame; a trampoline mat operatively surrounded by the trampoline frame; and a plurality of trampoline spring members operatively coupled between the trampoline frame and the trampoline mat. Each trampoline spring member at least includes: a first spring coupler located at a first end of the spring member; a second spring coupler located at a second end of the spring member; a first spring member section coupled to the first spring coupler; a second spring member section coupled to the second spring coupler; at least a third spring member section coupled between the first spring member section and the second spring member section, the third spring member section having a spring constant greater than the spring constants of the first and second spring member sections. The effective spring constant of the spring members increases stepwise with increases in the forces transmitted by trampoline users, and overall spring member deflections are dampened with increases in the forces transmitted by trampoline users.

12 Claims, 6 Drawing Sheets

TRAMPOLINE HAVING SUBSTANTIALLY SIMILAR MAT DEFLECTION UNDER VARYING LOADS

FIELD OF THE INVENTION

The present invention relates to trampolines, and improvements in the performance of trampolines.

DESCRIPTION OF THE RELATED ART

As is well known, trampolines are recreational and sometimes sporting and entertainment apparatuses designed to both enhance a trampolinist's jump height and greatly cushion his or her return bounce. Nominally, a trampoline consists of a sturdy frame often in a circular or rectangular shape (although others are possible) with frame legs that raise the trampoline above the ground, a flexible mat upon which a trampolinist can bounce or jump, and several springs attached between the mat and the frame.

The mat deflection is directly proportional to the impulse forces transmitted by the trampolinist during a bouncing or jumping session. The mat deflection is inversely proportional to the spring constants of the trampoline spring members. If the spring constants are too high, the mat may not undergo the proper deflection needed for comfort or tumbling by a typical user. If the spring constant is lower, an appropriate amount of mat deflection may be achieved for a normal weight user. However, heavier users may cause excessive mat deflections and elevated spring fatigue.

The prior art approach to keeping mat deflections from being excessive is to use lower spring constants, but restrict the weights of trampolinists (sometimes to relatively low weights). Even so, there may still be very large variations in mat deflections.

What is therefore desirable but non-existent in the prior art, is an effective scheme for limiting variations in trampoline mat deflections. What is also desirable is a trampoline that can safely and effectively accommodate a larger range of trampolinist weights.

SUMMARY OF THE INVENTION

The present invention has been developed in response to the present state of the art, and in particular, in response to the problems and needs in the art that have not yet been fully solved by currently available trampolines. Accordingly, the present invention has been developed to provide a novel trampoline that at least includes: a trampoline frame; a trampoline mat operatively surrounded by the trampoline frame; and a plurality of trampoline spring members operatively coupled between the trampoline frame and the trampoline mat. Each trampoline spring member at least includes: a first spring coupler located at a first end of the spring member; a second spring coupler located at a second end of the spring member; a first spring member section coupled to the first spring coupler; a second spring member section coupled to the second spring coupler; at least a third spring member section coupled between the first spring member section and the second spring member section, the third spring member section having a spring constant greater than the spring constants of the first and second spring member sections. The effective spring constant of the spring members increases stepwise with increases in the forces transmitted by trampoline users, and overall spring member deflections are dampened with increases in the forces transmitted by trampoline users.

The present invention has also been developed to provide a trampoline that at least includes: a trampoline frame; a trampoline mat operatively surrounded by the trampoline frame; and a plurality of trampoline spring members operatively coupled between the trampoline frame and the trampoline mat. Each trampoline spring member at least includes: a first spring coupler located at a first end of the spring member; a second spring coupler located at a second end of the spring member; a first spring member section coupled between the first and second spring couplers; a second spring member section located within the first spring member section; a first deflection delayer coupled to a first end of the first spring member section and coupled to a first end of the second spring member section, the first deflection delayer adapted to delay the deflection of the first end of the second spring member section; and a second deflection delayer coupled to a second end of the first spring member section and coupled to a second end of the second spring member section, the second deflection delayer adapted to delay the deflection of the second end of the second spring member section.

The present invention has been further developed to provide a trampoline that at least includes: a trampoline frame; a trampoline mat operatively surrounded by the trampoline frame; and a plurality of trampoline spring members operatively coupled between the trampoline frame and the trampoline mat. Each trampoline spring member at least includes: a first spring coupler located at a first end of the spring member; a second spring coupler located at a second end of the spring member; a first spring member section coupled to the first spring coupler; a second spring member section coupled to the second spring coupler; at least a third spring member section coupled between the first spring member section and the second spring member section, the third spring member section having a spring constant lower than the spring constants of the first and second spring member sections. The wire cross-section area of the spring member sections is substantially identical, and the projected longitudinal area of the third spring member section is larger than the projected longitudinal areas of the first and second spring member sections. The effective spring constant of the spring members increases stepwise with increases in the forces transmitted by trampoline users, and the overall spring member deflections are dampened with increases in the forces transmitted by trampoline users.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
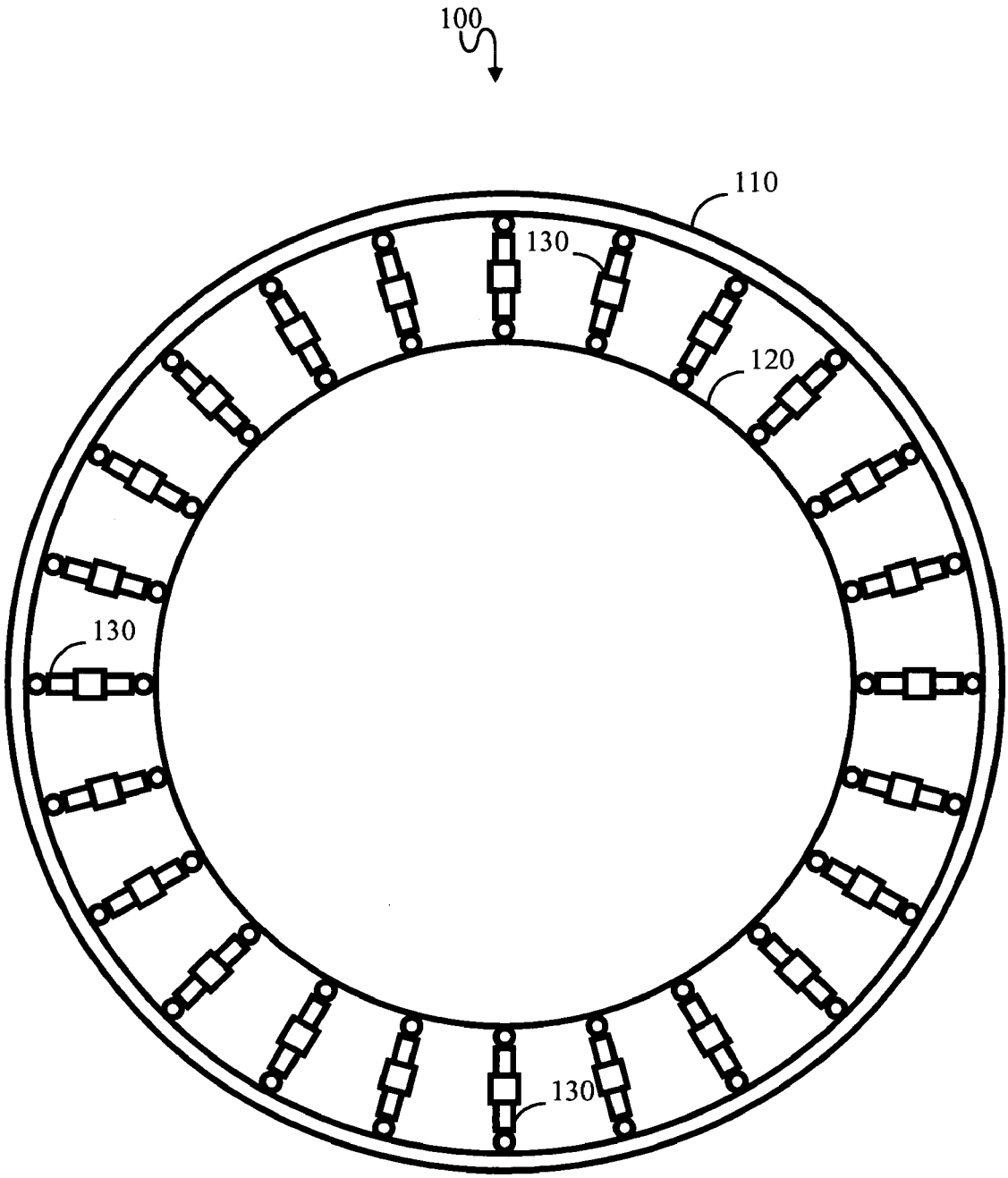
FIG. 1 is a top view of a version of the present-inventive trampoline.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to those skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

The present-inventive trampoline is shown from the top in FIG. 1. The trampoline 100 includes a trampoline frame 110 with frame legs (not shown), a trampoline mat 120, several novel trampoline spring members 130, and a pad (not shown) which covers the spring members for safety.

Figure 2:
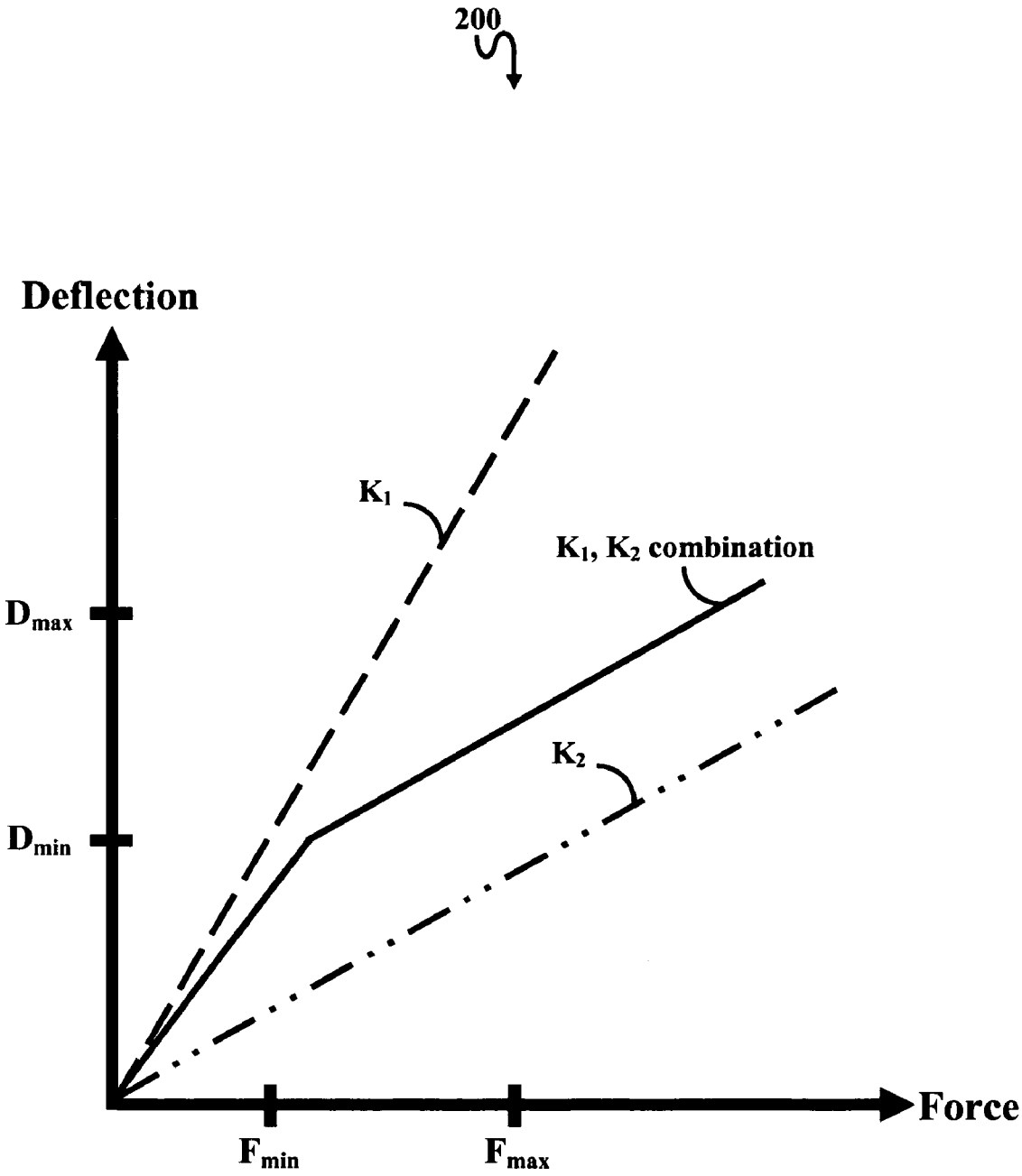
FIG. 2 shows graphs of deflection versus force for prior art single spring constant spring members, and of a present-inventive spring member having a hybrid spring constant.

The spring members function to provide a hybrid spring constant as will be further described below. The graph labeled $K_1$ in FIG. 2 is that of deflection versus force for a prior art spring member. Also in FIG. 2, the graph labeled $K_2$ is the response of a prior art spring member with a higher spring constant than for the $K_1$ spring member. It can be readily seen that for a given force exerted by a trampolinist, the deflection is higher in the spring member with the lower spring constant K. The deflection axis in FIG. 2 also shows a range of mat deflections from up to the maximum desired deflection $d_{maxideal}$, and down to a minimum desired deflection $d_{minideal}$ for an average weight trampolinist.

The third graph in FIG. 2 is that of the response of a present-inventive spring member with a hybrid effective spring constant. The latter graph shows that up to a point, the response is similar to that of a lower spring constant spring member. When the mat impulse force reaches a certain level (consistent with heavier trampolinists or high jumping heights) the response begins to resemble that of the higher spring constant spring member with a lower slope. As a result, the deflection at the maximum force is lower than would be for the $K_1$ spring member, and the deflection at the minimum force (for average jumping by an average weight trampolinist) is higher than would be for the $K_2$ spring member. Thus, the present-inventive spring members create a restricted range of deflection for a larger weight range of trampolinists.

Figure 3:
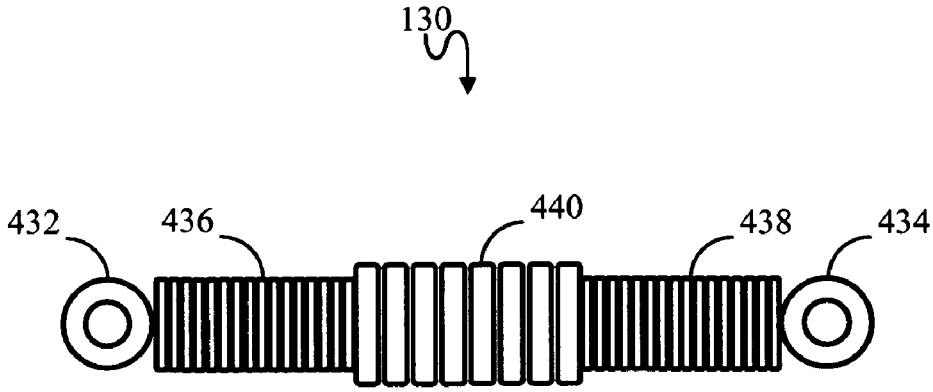
FIG. 3 is a side view of a first version of the present-inventive spring member in a contracted state.

A first version of the present-inventive spring member 130 is shown in FIG. 3. The spring member 130 includes two spring member coupling ends 432 and 434 for coupling the spring member between the trampoline frame and the trampoline mat. First and second spring member sections 436 and 438 connect to a middle spring member section 440. The spring constant K for the middle spring member section 440 is distinctly higher than the spring constants of the outside spring member sections 436 and 438. All of the spring member sections can be molded as one piece. Alternatively, the different sections can be joined by welds or mechanical means.

Figure 4:
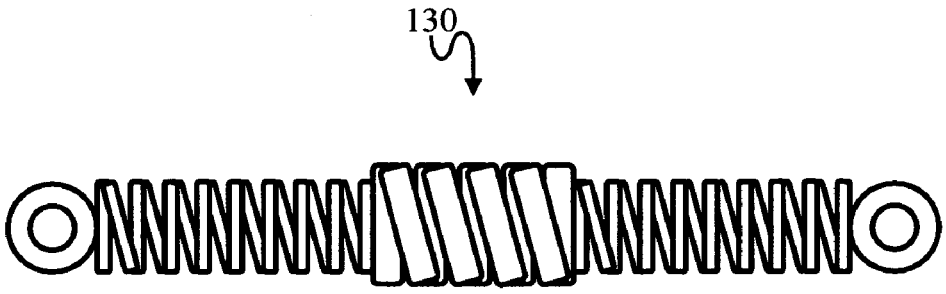
FIG. 4 is a side view of spring member of FIG. 3 in an expanded state.

In operation, the outside sections deflect first when the spring member is placed in tension. The middle section deflects little in the beginning. When the deflections of the outside sections reach a predetermined level, deflection limiters 450 cause the outside sections to stop further deflection. At that point, additional deflection of the spring member occurs through the middle section. The deflection limiter serves to protect the outside spring member sections from inelastic deflections and excessive fatiguing. The spring member is shown in an expanded state in FIG. 4.

Figure 5:
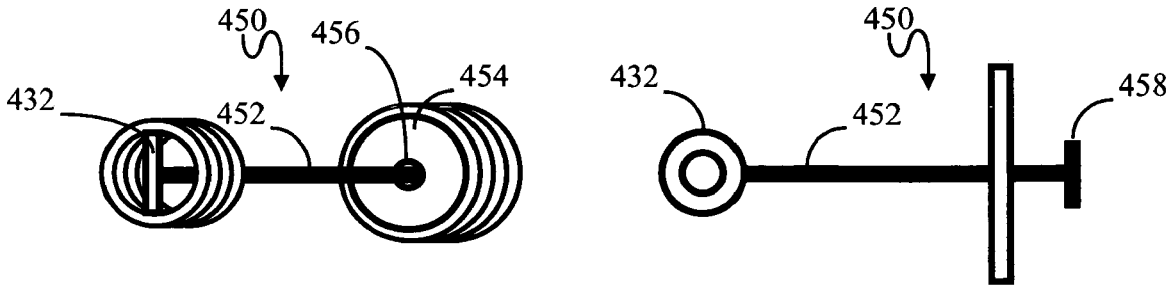
FIG. 5 shows oblique and side views of the deflection limiter of the present-inventive spring member.

One version of a suitable deflection limiter is shown in FIG. 5. A plate 454 with a void 456 is fixed to the end of the middle spring member section. The void 456 receives a rod 452 with a stop 458 at its end. The rod 452 is fixed to the end of the outer spring member sections (or alternatively to the end couplers 432 and 434). When the outside spring members expand, the rods 452 continue to move axially with the spring sections until the stop 458 reaches the plate 454. At this point, no further expansion of the outside spring member sections is allowed. Further expansion of spring members is via the middle spring member section.

Figure 6:
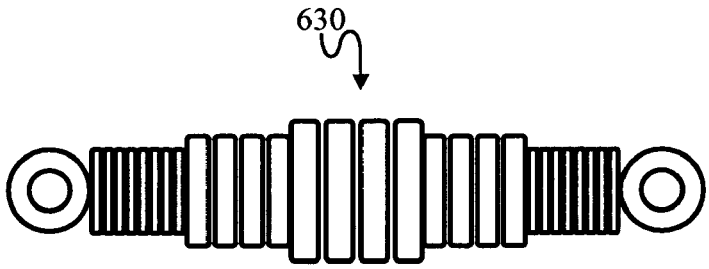
FIG. 6 is a side view of a second version of the spring member of the present-inventive trampoline.

The present-inventive spring member is not limited to three spring member section versions. For example, a five section spring member 630 is illustrated in FIG. 6. The embodiment 630, which operates similar to the embodiment 130, may also contain several deflection limiters.

Figure 7:
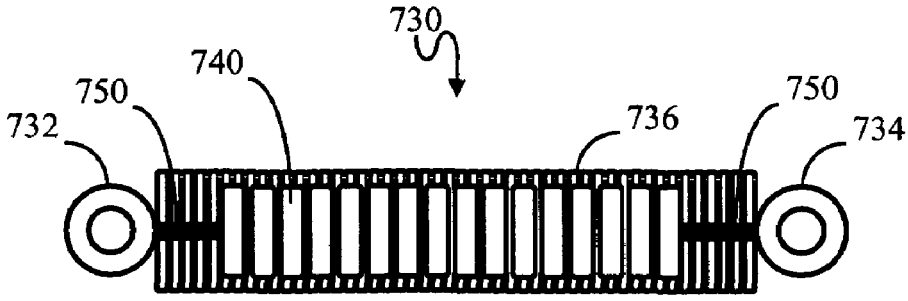
FIG. 7 is a cutaway side view of a third version of the spring member of the present-inventive spring member.

Yet another version of the spring member for the present-inventive trampoline is shown in the cutaway view of FIG. 7. In this dual spring version of a spring member 730, a lower spring constant member section 736 surrounds a higher spring constant member section 740. The lower spring constant section 736 is directly connected to spring member coupler ends 732 and 734. The higher member section 740 is slidably connected to the spring member ends 732 and 734 via deflection limiters 750. A minor role of the deflection limiters is to constrict the expansion of the spring member section 736 near its ends. The primary role of the deflection limiters is to engage the spring member section 740 when the tension force in the spring member causes the spring member section 736 to reach a threshold deflection. The deflection limiters 750 are connected to the spring member consistent with the approach with respect to the spring member 130, supra.

Figure 8:
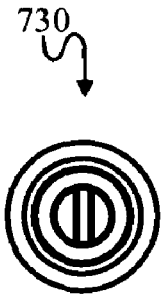
FIG. 8 is a cutaway longitudinal view (as seen from the middle to an end) of the spring member of FIG. 7.

FIG. 8 illustrates the spring member 730 viewed longitudinally.

Figure 9:
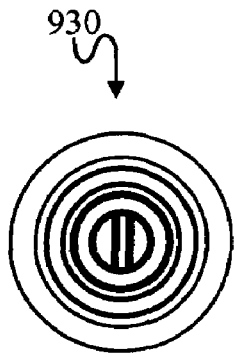
FIG. 9 is a cutaway longitudinal view (as seen from the middle to an end) of a fourth version of the spring member of the present-inventive trampoline.

Given the above description, a layered spring member may include more than two concentric spring member sections. For example, a spring member 930 with three concentric spring member sections is shown (viewed longitudinally from the middle outward) in FIG. 9.

Figure 10:
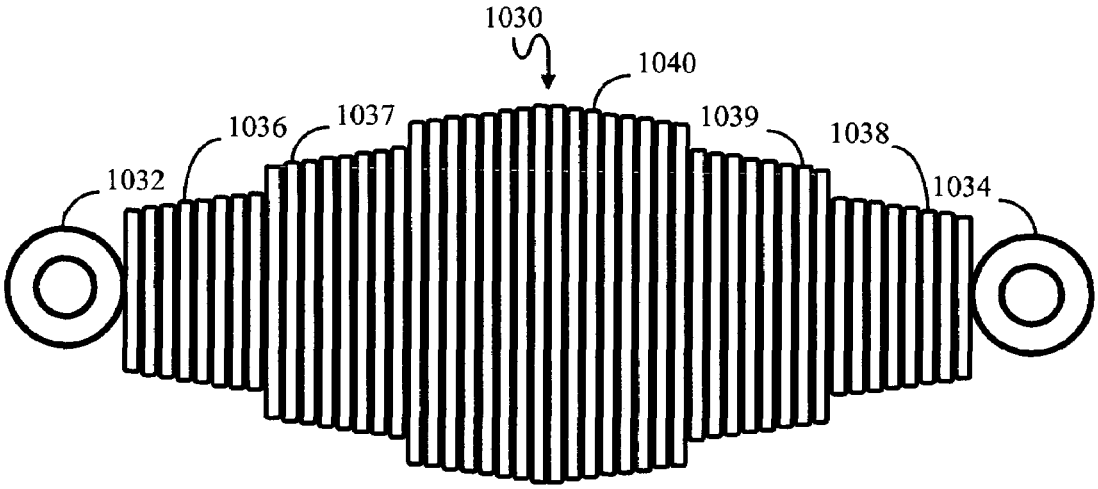
FIG. 10 is a side view of a fifth version of the spring member of the present-inventive trampoline.

Yet another version of the spring member used in conjunction with the present-inventive trampoline is shown in FIG. 10. The spring member section 1030 has its lowest spring constant in its middle spring member section 1040. All of the spring wires in each spring member section have the same wire diameter and wire shape, and the spring member is a single long wire, albeit wound into several distinct sections. Additionally, the outside diameter of the middle spring member section 1040 continually tapers until it reaches the beginning of adjacent spring member sections 1037 and 1039. At the beginning of section 1037 (at the juncture with section 1040), the outside diameter of section 1037 is distinctly smaller than the diameter of section 1040. The same is true of the juncture between sections 1037 and 1036, where the outside diameter of section 1036 is distinctly smaller than the diameter of section 1037.

The diameters at the junctures of sections 1040 and 1039, as well as the diameters at the junctures of sections 1039 and 1038 are identically dimensioned as described above at the aforementioned junctures (between sections 1040 and 1037, and between sections 1037 and 1036, respectively). The spring member 1030 also includes spring member couplers 1032 and 1034. Those skilled in the art will appreciate that for the identical spring wire used in the spring member sections, the outside diameters of the spring member sections are inversely proportional to their spring constants. Further, in the preferred embodiment, the diameter discontinuities between the spring member sections measure no more than twice the spring wire diameter. This need not be the case for other embodiments.

In operation, the middle spring member section 1040 deflects first when the spring member 1030 is placed under tension. The spring member sections 1037 and 1039 then begin to deflect, followed by the deflection of spring member sections 1036 and 1038 with increasing tension. Additionally, the overall effective spring constant of the spring member 1030 increases as the tension force on the spring member increases.

Figure 11:
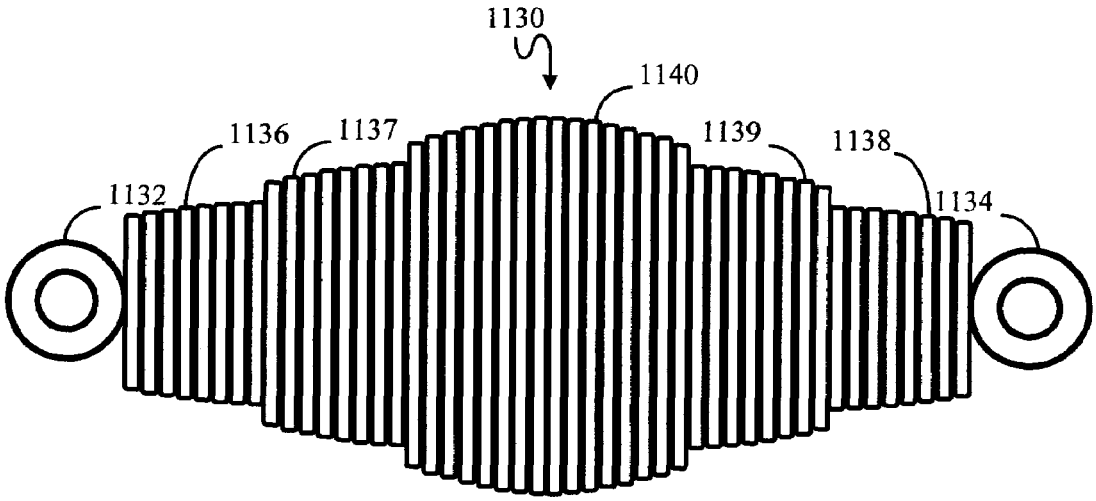
FIG. 11 is a side view of a sixth version of the spring member of the present-inventive trampoline

The spring member 1130 in FIG. 11 is very similar to the spring member 1030 described above. The principal difference between the two spring members is that the diameter tapering in the spring member sections of the spring member 1030 is linear, whereas the diameter tapering in the spring member sections of the spring member 1130 is non-linear. Otherwise, the elements 1132 1134, 1136, 1137, 1138, 1139, and 1140 in FIG. 11 are identical to the elements 1032 1034, 1036, 1037, 1038, 1039, and 1040 in FIG. 10, respectively.

It is understood that the above-described preferred embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

It is expected that there could be numerous variations of the design of this invention. For example, in one embodiment there may be a spring including different materials imparting varying strengths and therefore varying spring constants. There may be an embodiment including any combination of materials, portions, spring dimensions (including wire diameter, wire configuration, coil diameter, coil shape, spring length, etc;) that imparts an increasing spring constant whether gradual and/or stepped. Finally, it is envisioned that the components of the device may be constructed of a variety of materials.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A trampoline comprising:

a trampoline frame;

a trampoline mat operatively surrounded by said trampoline frame; and a plurality of trampoline spring members operatively coupled between said trampoline frame and said trampoline mat, each trampoline spring member comprising:

a first spring coupler located at a first end of said spring member;

a second spring coupler located at a second end of said spring member;

a first spring member section coupled to said first spring coupler;

a second spring member section coupled to said second spring coupler;

at least a third spring member section coupled between said first spring member section and said second spring member section, said third spring member section having a spring constant greater than the spring constants of said first and second spring member sections;

wherein the effective spring constant of said spring members increases stepwise with increases in the forces transmitted by trampoline users, and overall spring member deflections are dampened with increases in the forces transmitted by trampoline users.

2. The trampoline of claim 1, wherein said trampoline spring members further comprise:

a first deflection limiter coupled to said first spring member section and coupled to said third spring member section, said first deflection limiter adapted to limit the amount of deflection in said first spring member section; and a second deflection limiter coupled to said second spring member section and coupled to said third spring member section, said second deflection limiter adapted to limit the amount of deflection in said second spring member section.

3. The trampoline of claim 1, wherein said trampoline spring members further comprise:

a fourth spring member section coupled between said first and third spring member sections; and a fifth spring member section coupled between said second and third spring member sections;

wherein said fourth and fifth member sections have spring constants higher than said first and second spring member sections, and said fifth spring member section has a spring constant higher than said third and fourth spring member sections.

4. The trampoline of claim 1, wherein said trampoline spring members further comprise:

a fourth spring member section coupled between said first and third spring member sections;

a fifth spring member section coupled between said second and third spring member sections;

wherein said fourth and fifth member sections have spring constants higher than said first and second spring member sections, and said fifth spring member section has a spring constant higher than said third and fourth spring member sections;

a first deflection limiter coupled to said first spring member section and coupled to said fourth spring member section, said first deflection limiter adapted to limit the amount of deflection in said first spring member section;

a second deflection limiter coupled to said second spring member section and coupled to said fifth spring member section, said second deflection limiter adapted to limit the amount of deflection in said second spring member section;

a third deflection limiter coupled to said third spring member section and coupled to said fourth spring member section, said third deflection limiter adapted to limit the amount of deflection in said fourth spring member section; and a fourth deflection limiter coupled to said third spring member section and coupled to said fifth spring member section, said fourth deflection limiter adapted to limit the amount of deflection in said fifth spring member section.

5. The trampoline of claim 1, wherein overall spring member deflections are dampened stepwise with increases in the forces transmitted by trampoline users.

6. A trampoline comprising:

a trampoline frame;

a trampoline mat operatively surrounded by said trampoline frame; and a plurality of trampoline spring members operatively coupled between said trampoline frame and said trampoline mat, each trampoline spring member comprising:

a first spring coupler located at a first end of said spring member;

a second spring coupler located at a second end of said spring member;

a first spring member section coupled to said first spring coupler;

a second spring member section coupled to said second spring coupler;

at least a third spring member section coupled between said first spring member section and said second spring member section, said third spring member section having a spring constant lower than the spring constants of said first and second spring member sections;

wherein the wire cross-section area of said spring member sections is substantially identical, wherein the projected longitudinal area of said third spring member section is larger than the projected longitudinal areas of said first and second spring member sections, wherein the effective spring constant of said spring members increases stepwise with increases in the forces transmitted by trampoline users, and wherein overall spring member deflections are dampened with increases in the forces transmitted by trampoline users.

7. The trampoline of claim 6, wherein said trampoline spring members further comprise:

a fourth spring member section coupled between said first and third spring member sections; and a fifth spring member section coupled between said second and third spring member sections;

wherein said fourth and fifth member sections have spring constants lower than said first and second spring member sections, and said fifth spring member section has a spring constant lower than said third and fourth spring member sections.

8. The trampoline of claim 6, wherein said third spring member section has a diameter that tapers downward toward and end of said spring member along the longitudinal axis, said first and second spring member sections have diameters that taper downward toward distal ends of said spring member, and the ends of said first and second spring member sections proximal to said third spring member section have diameters discretely smaller than diameter of said third spring member section adjacent to said first and second spring member sections.

9. The trampoline of claim 6, wherein the discrete reductions in the diameters of adjacent spring member sections is no more than twice the spring wire diameters.

10. The trampoline of claim 7, wherein the tapering is linear.

11. The trampoline of claim 7, wherein the tapering is non-linear.

12. The trampoline of claim 6, wherein overall spring member deflections are dampened stepwise with increases in the forces transmitted by trampoline users.

* * * * *